US007810739B2

(12) United States Patent
Tazawa et al.

(10) Patent No.: US 7,810,739 B2
(45) Date of Patent: Oct. 12, 2010

(54) AIR CONDITIONER

(75) Inventors: Tetsuya Tazawa, Tokyo (JP); Toshihiro Hotta, Tokyo (JP); Kazuhito Kojima, Tokyo (JP); Hiroshi Oomura, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 490 days.

(21) Appl. No.: 11/987,875

(22) Filed: Dec. 5, 2007

(65) Prior Publication Data

US 2009/0057432 A1 Mar. 5, 2009

(30) Foreign Application Priority Data

Aug. 30, 2007 (JP) ..... 2007-223993

(51) Int. Cl.
*G05D 23/19* (2006.01)

(52) U.S. Cl. ..... 236/91 C; 62/186

(58) Field of Classification Search ..... 62/186, 62/207, 262, 426; 236/DIG. 6; 374/121
See application file for complete search history.

(56) References Cited

U.S. PATENT DOCUMENTS

| | | | | |
|---|---|---|---|---|
| 5,297,395 | A * | 3/1994 | Ozu et al. | 62/174 |
| 5,381,950 | A * | 1/1995 | Aldridge | 236/1 R |
| 6,293,118 | B1 * | 9/2001 | Oh | 62/229 |
| 2002/0189274 | A1 * | 12/2002 | Lee et al. | 62/298 |
| 2004/0060314 | A1 * | 4/2004 | Gunji et al. | 62/262 |

FOREIGN PATENT DOCUMENTS

| | | | |
|---|---|---|---|
| JP | 61149751 | A * | 7/1986 |
| JP | 4-86447 | A | 3/1992 |
| JP | 06-105236 | | 4/1994 |
| JP | 06-105882 | | 4/1994 |
| JP | 7-63400 | A | 3/1995 |
| JP | 09-072781 | | 3/1997 |
| JP | 11-054962 | | 2/1999 |
| JP | 2001-059640 | | 3/2001 |
| JP | 2003-074952 | | 3/2003 |
| JP | 2003-185226 | | 7/2003 |
| JP | 2003-262359 | | 9/2003 |
| JP | 2007-032887 | | 2/2007 |

OTHER PUBLICATIONS

European Search Report in corresponding Application No. 07023762.3 dated Feb. 19, 2009.

* cited by examiner

*Primary Examiner*—George Nguyen
(74) *Attorney, Agent, or Firm*—Buchanan Ingersoll & Rooney PC

(57) ABSTRACT

The invention provides an air conditioner including a radiant sensor device assembly inside a front panel of an indoor unit, in which a radiant sensor holder for holding a radiant sensor and a radiant sensor holder drive mechanism are assembled into the radiant sensor device assembly, the radiant sensor holder drive mechanism includes four projections provided on a part of the outer periphery of the radiant sensor holder in the radial directions, a drive motor attached to the radiant sensor device assembly so that the direction of a motor shaft extends in the same direction as the axis of rotation of the radiant sensor holder, and a sector-shaped connecting member being attached to the motor shaft and having three pins to be fitted between the four projections on the radiant sensor holder respectively for driving the projections.

6 Claims, 8 Drawing Sheets

9 ASSEMBLY FIXING PORTION
10 WIND DIRECTION AND WIND QUANTITY DISPLAY UNIT
11 VARIOUS DISPLAY UNITS
12 REMOTE CONTROL RECEIVER
13 LEAD HOLDING UNIT
14 LEAD WIRES
15 DISPLAY PANEL HOLDER
17 RADIANT SENSOR COVER

1 INDOOR UNIT
2 SENSOR HOLDER
3 RADIANT SENSOR
4 FRONT PANEL
5 AIR OUTLET PORT

9 ASSEMBLY FIXING PORTION
10 WIND DIRECTION AND WIND QUANTITY DISPLAY UNIT
11 VARIOUS DISPLAY UNITS
12 REMOTE CONTROL RECEIVER
13 LEAD HOLDING UNIT
14 LEAD WIRES
15 DISPLAY PANEL HOLDER
17 RADIANT SENSOR COVER

6 RADIANT SENSOR HOLDER
8 RADIANT SENSOR DEVICE ASSEMBLY
17 RADIANT SENSOR COVER
18 DRIVE MOTOR

15 DISPLAY PANEL HOLDER

6 RADIANT SENSOR HOLDER
8 RADIANT SENSOR DEVICE ASSEMBLY
18 DRIVE MOTOR
20 ASSEMBLY PLATE
21 DRIVE MOTOR FIXING PLATE
22 RADIANT SENSOR HOLDER PIVOTABLY SECURING PLATE
22A PIVOTABLY SECURING HOLE
23 BOSS

24 PROJECTION
25 FAN-SHAPED CONNECTING MEMBER
26 PIN

28 BAND
29 BAND FIXING MEMBER

AIR CONDITIONER

BACKGROUND OF THE INVENTION

1. Field of the Invention

The present invention relates to an air conditioner having a radiant sensor drive mechanism for driving a radiant sensor for detecting the temperature of a floor surface.

2. Description of the Related Art

In recent years, an air conditioner which detects the temperature of a floor surface in a room and controls the temperature, the direction, and the quantity of wind delivered toward the floor surface on the basis of the result of detection to achieve a comfortable air conditioning is proposed.

In air conditioners in the related art, a radiant sensor is arranged beside an air outlet port on the lower side of a front panel, for detecting the temperature of a floor in the direction obliquely toward the front from the right below an indoor unit, and hence the radiant sensor is slanted.

Since there is a space on an extension line of the axis of rotation of the slanted radiant sensor, a drive motor is installed in the space so that the radiant sensor is directly driven by the drive motor (For example, see Japanese Unexamined Patent Application Publication No. 7-63400, P.3, FIG. 3).

However, in air conditioners in the related art other than that shown above, the position to install the radiant sensor is not necessarily at the lower side of the front panel beside the air outlet port where a space remains, and the radiant sensor may be arranged above the air outlet port in a slanted posture. In such a case, in order to position the front panel on the extension line of the axis of rotation of the radiant sensor arranged in the slanted posture, there is no space for installing the drive motor in view of design, so that the drive motor which directly drives the radiant sensor cannot be installed.

SUMMARY OF THE INVENTION

In view of such problem as described above, it is an object of the invention to obtain an air conditioner including a drive mechanism which is capable of driving a radiant sensor by a drive motor positioned inside a front panel and inside the axis of rotation of the radiant sensor, different from a position on an extension line of the axis of rotation of the radiant sensor arranged in a slanted posture, and which is easy to assemble with simplified components.

An air conditioner according to the invention comprises an indoor unit including a front panel, a radiant sensor for detecting the temperature and a radiant sensor holder for holding the radiant sensor, which is arranged inside the front panel and capable of rotating leftward and rightward. A radiant sensor device assembly is provided inside the front panel of the indoor unit. The radiant sensor holder and a radiant sensor holder drive mechanism for driving the radiant sensor holder are assembled into the radiant sensor device assembly. The radiant sensor holder drive mechanism includes a plurality of projections provided on a part of the outer periphery of the radiant sensor holder so as to project in the radial directions, a drive motor which is installed in the radiant sensor device assembly so that the direction of the shaft of the drive motor extends in the same direction as the axis of rotation of the radiant sensor holder, and a sector-shaped connecting member being attached to the shaft of the drive motor and having a plurality of pins to be fitted between the plurality of projections provided on the radiant sensor holder respectively for driving the projections.

According to the radiant sensor holder drive mechanism in the air conditioner in the invention includes the plurality of projections provided on the part of the periphery of the radiant sensor holder so as to project in the radial directions, the drive motor which is installed in the radiant sensor device assembly so that the direction of the shaft of the drive motor extends in the same direction as the axis of rotation of the radiant sensor holder, and the sector-shaped connecting member being attached to the shaft of the drive motor and having the plurality of pins to be fitted between the plurality of projections provided on the radiant sensor holder respectively for driving the projections, and is configured in such a manner that the radiant sensor holder is rotated leftward and rightward by the plurality of pins of the sector-shaped connecting member attached to the shaft of the drive motor, pushing the plurality of projections provided on the part of the outer periphery of the radiant sensor holder projecting in the radial direction. Therefore, it is not necessary to arrange the shaft of the drive motor on the axis of rotation of the radiation sensor holder, and hence the drive motor can be advantageously provided inside the front panel and inside the radiant sensor holder.

Since the radiant sensor holder drive mechanism includes the sector-shaped connecting member having the plurality of pins attached to the motor shaft of the drive motor and the plurality of projections provided on the part of the outer periphery of the radiant sensor holder so as to receive the plurality of pins respectively therebetween, in addition to the drive motor, the components are simplified, so that the simplified components are easily assembled. Even through the radiant sensor holder and the drive motor are apart from each other, the sector-shaped connecting member is advantageously prevented from being deflected, and hence deviation of the drive angle can be prevented.

DESCRIPTION OF THE PREFERRED EMBODIMENTS

First Embodiment

Figure 1:
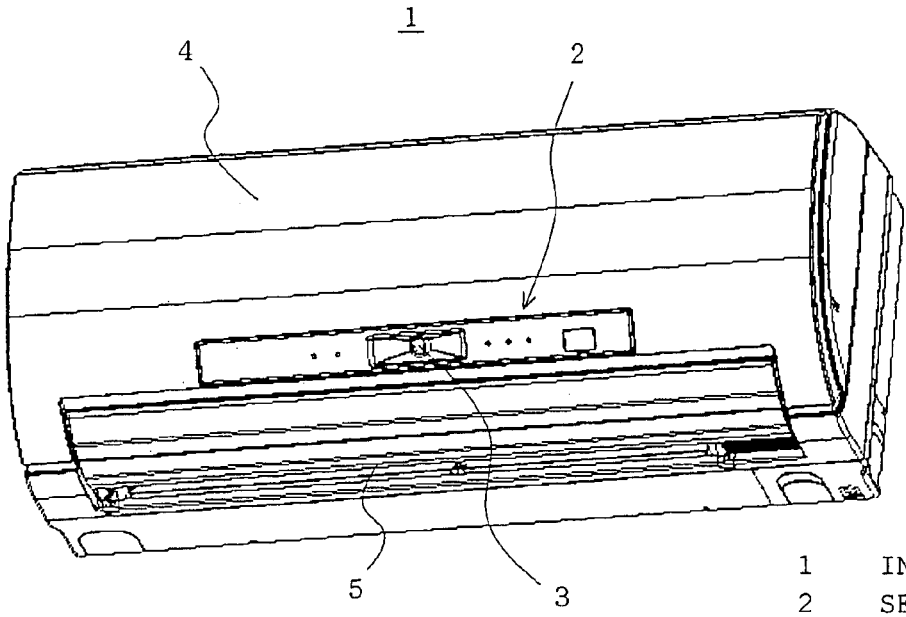
FIG. 1 is a perspective view showing an air conditioner according to a first embodiment of the invention.
Figure 2:
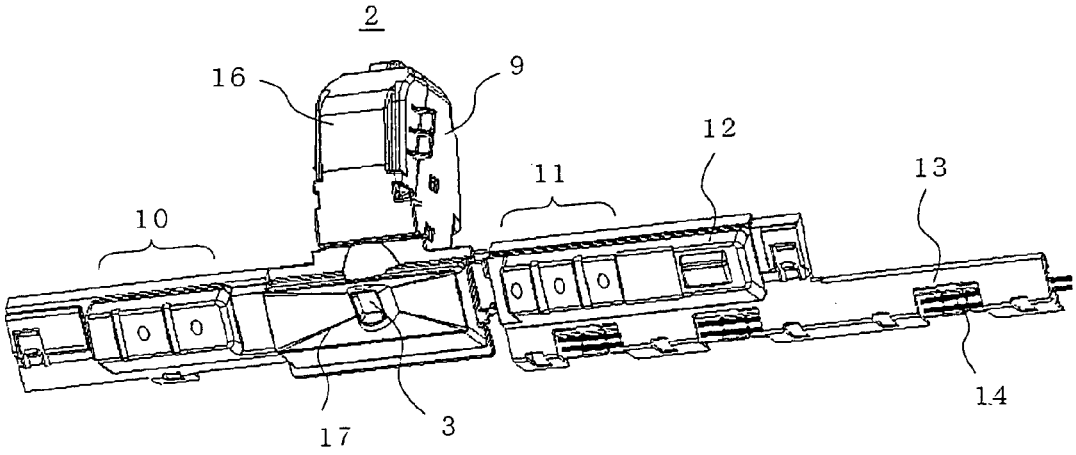
FIG. 2 is a perspective view showing a sensor holder of the air conditioner.
Figure 3:
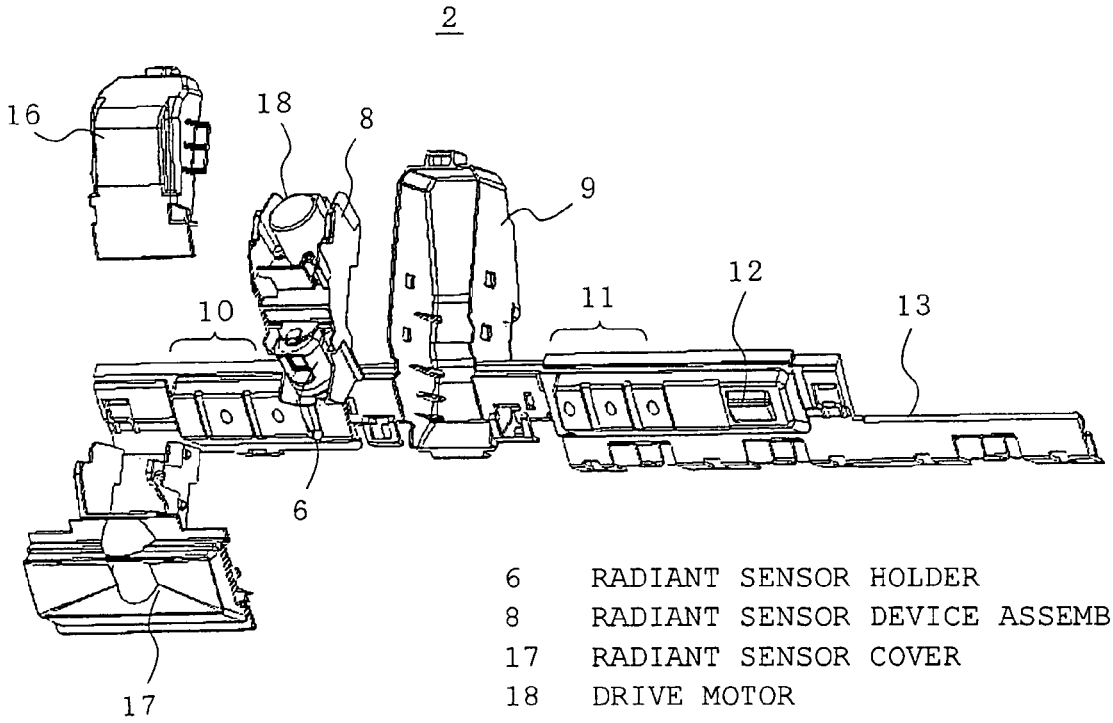
FIG. 3 is a perspective view showing an exploded state of the sensor holder of the air conditioner.
Figure 4:
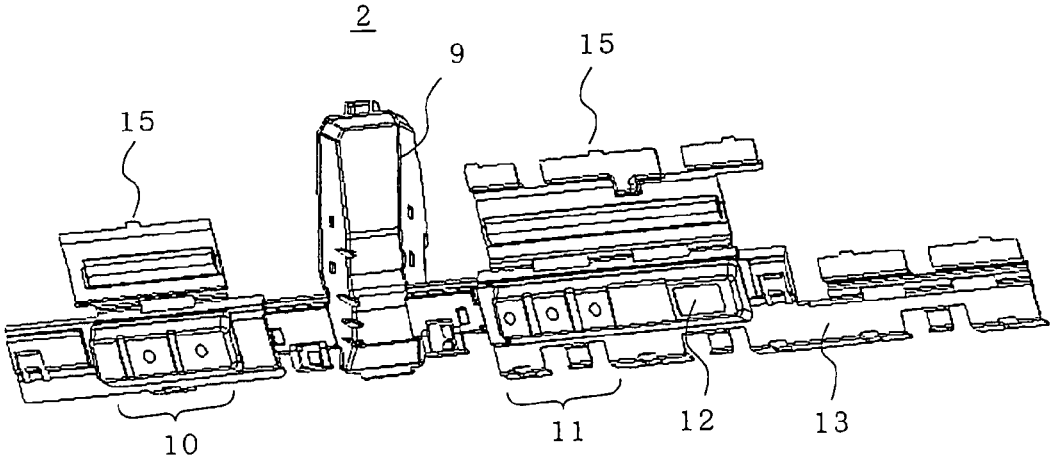
FIG. 4 is a perspective view showing the sensor holder and a display panel holder of the air conditioner.
Figure 5:
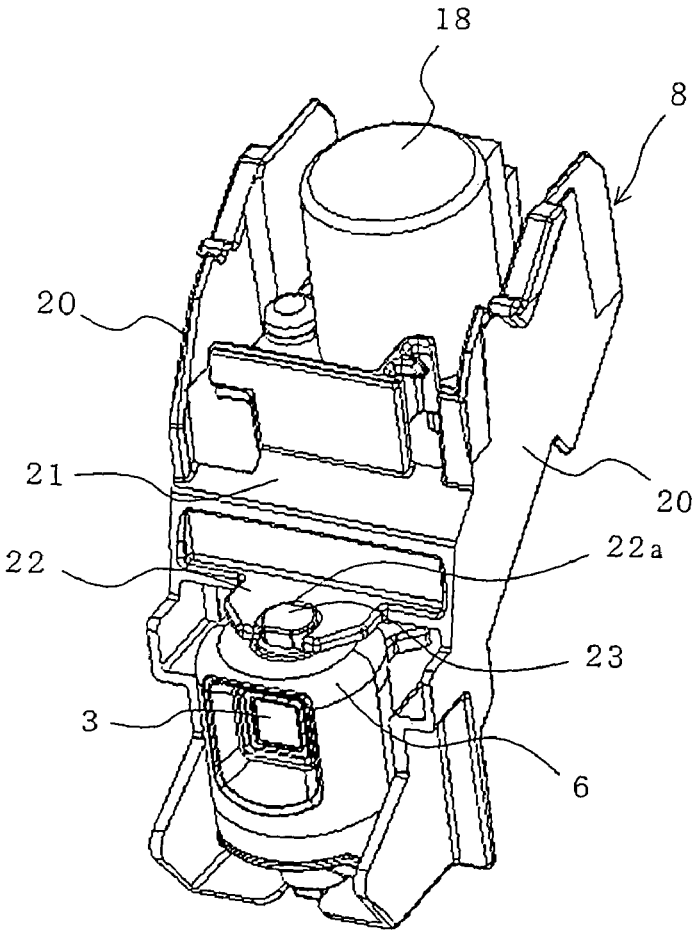
FIG. 5 is a perspective view showing a front surface of a radiant sensor device assembly of the air conditioner.
Figure 6:
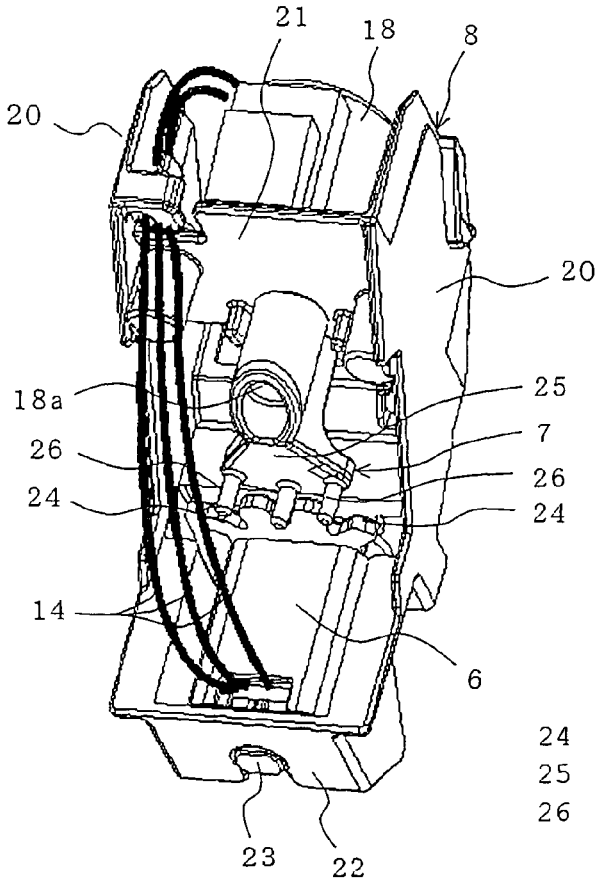
FIG. 6 is a perspective view showing a rear surface of the radiant sensor device assembly of the air conditioner.
Figure 7:
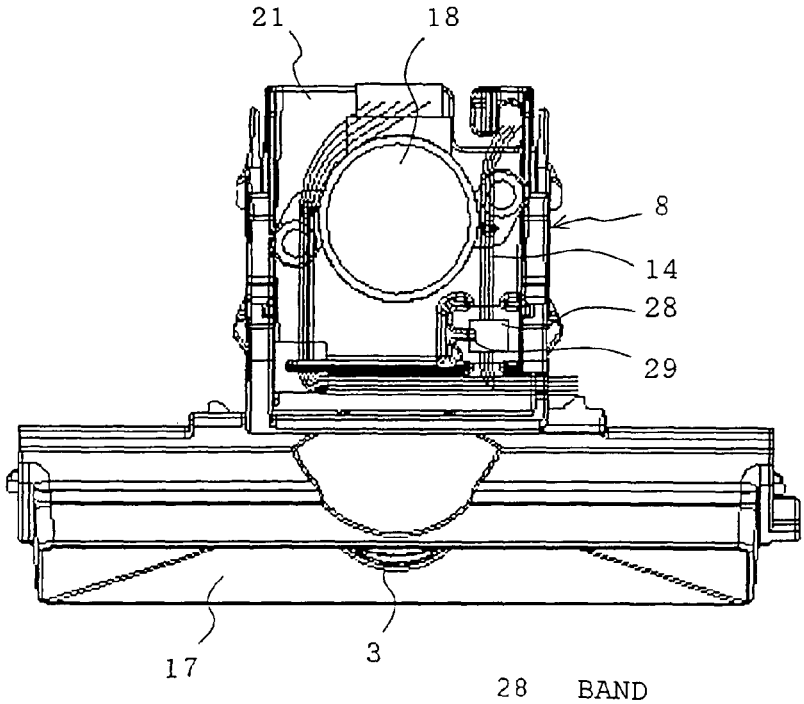
FIG. 7 is a perspective view showing an upper surface of the radiant sensor device assembly of the air conditioner.
Figure 8:
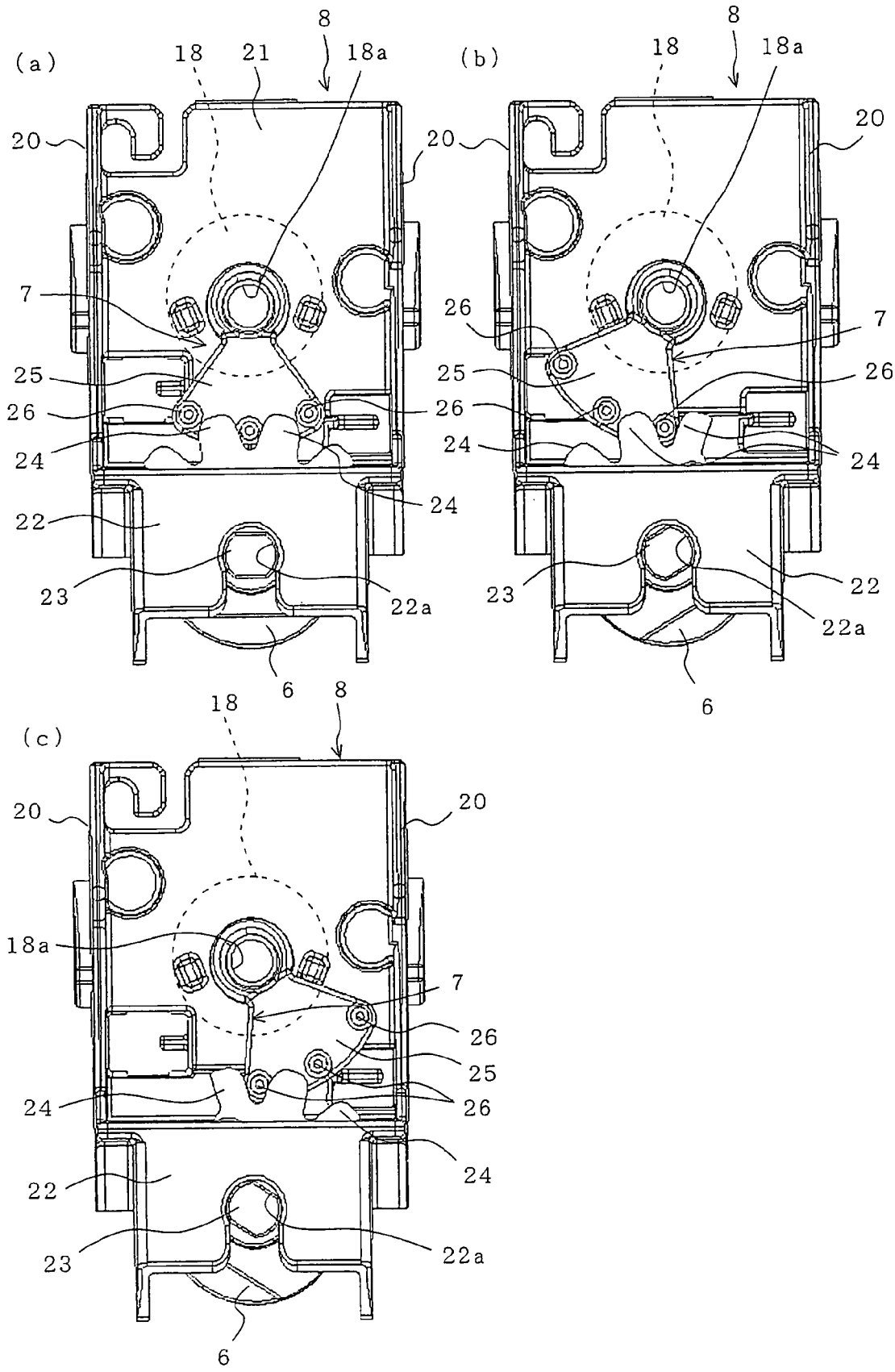
FIGS. 8A to 8C illustrate a configuration of a radiant sensor holder drive mechanism of the air conditioner.

FIG. 1 is a perspective view showing an air conditioner according to a first embodiment of the invention; FIG. 2 is a perspective view showing a sensor holder of the air conditioner; FIG. 3 is a perspective view showing an exploded state of the sensor holder of the air conditioner; FIG. 4 is a perspective view showing the sensor holder and a display panel holder of the air conditioner; FIG. 5 is a perspective view showing a front surface of a radiant sensor device assembly of the air conditioner; FIG. 6 is a perspective view showing a rear surface of the radiant sensor device assembly of the air conditioner; FIG. 7 is a perspective view showing an upper surface of the radiant sensor device assembly of the air conditioner; FIGS. 8A to 8C illustrate a configuration of a radiant sensor holder drive mechanism of the air conditioner; and FIGS. 9A to 9C are an explanatory drawing showing a step of removing the radiant sensor holder of the air conditioner.

In FIG. 1, a laterally elongated sensor holder 2 is provided at the center portion of an indoor unit 1 of the air conditioner, and an infrared ray radiant sensor 3 for measuring the temperature of a floor or a wall in a room is attached at the center of the sensor holder 2. The indoor unit 1 is provided with a front panel 4 on the upper portion of the indoor unit 1, and an air outlet port 5 is provided on the lower portion of the indoor unit 1.

As shown in FIG. 2 to FIG. 4, the radiant sensor 3 is held by a radiant sensor holder 6, and the radiant sensor holder 6 and a radiant sensor holder drive mechanism 7 for rotating the radiant sensor holder 6 rightward and leftward are assembled into a radiant sensor device assembly 8.

The laterally elongated sensor holder 2 for attaching the radiant sensor 3 and the like is formed of synthetic resin, and includes: an assembly fixing portion 9 formed into a box-shape for fixedly attaching and housing the radiant sensor device assembly 8 therein in the middle thereof; a laterally elongated wind direction and wind quantity display portions 10 provided on the left side thereof; laterally elongated various display portions 11 for displaying the operating state as ON or OFF and an operation monitor and a remote control receiver portion 12, provided on the right side thereof; and a laterally elongated lead holding portion 13 for holding lead wires 14 to be extended to the display portions 10 and 11, and the remote control receiver portion 12, provided on the right side of the remote control receiver portion 12.

The lead holding unit 13 has a hinge structure, and holds the lead wires 14 by being folded as shown in FIG. 2 for guiding the lead wires 14 to a control panel (not shown) arranged-beside the indoor unit 1.

As shown in FIG. 4, display panel holders 15 are provided via a hinge structure on one side of the wind direction and wind quantity display unit 10, the various display units 11 and the remote control receiver 12, respectively. The display panel holders 15 are configured to hold a display panel (not shown) having LED in cooperation with the display units 10 and 11 by being folded at the hinge structures thereof toward the display units 10 and 11.

Reference numeral 16 designates an assembly fixing portion cover for covering an opening of the assembly fixing portion 9. Reference numeral 17 designates a radiant sensor cover for covering the radiant sensor 3 held by the radiant sensor holder 6, and is mounted to the radiant sensor holder 6.

In the first embodiment, the assembly fixing portion cover 16 is separated from the assembly fixing portion 9. However, it is needless to say that the assembly fixing portion cover 16 may be connected to the assembly fixing portion 9 via a hinge structure.

As described above, according to the sensor holder 2 in the first embodiment, the assembly fixing portion 9, the wind direction and wind quantity display unit 10, the various display units 11, the remote control receiver 12 and the lead holding unit 13 are formed integrally of synthetic resin, the display substrate holders 15 are provided on one side of the wind direction and wind quantity display unit 10, the various display units 11 and the remote control receiver 12 respectively via the hinge structures, and the lead holding unit 13 has the hinge structure. Therefore, the display substrate having the LED is held by the display units 10 and 11 by folding the display substrate holders 15 toward the display units 10 and 11 at the hinge structures, and the lead wires 14 are also held by folding the lead holding unit 13. Therefore, a plurality of the components are held by the single sensor holder 2 easily without providing a specific holding member.

Referring now to FIG. 5 to FIGS. 8A to 8C, configurations of the radiant sensor holder 6 and the radiant sensor holder drive mechanism 7 assembled into the radiant sensor device assembly 8 fixedly attached to the assembly fixing portion 9 of the sensor holder 2 will be described.

As shown in FIG. 5, the radiant sensor device assembly 8 includes opposing two assembly plates 20 and 20, a drive motor fixing plate 21 for connecting the two assembly plates 20 and 20, and a pair of radiant sensor holder pivotably securing plates 22 provided so as to oppose to each other between the two assembly plates 20 and 20.

Round bosses 23, which are provided at an upper portion and a lower portion on the rotation axis of the radiant sensor holder 6 which holds the radiant sensor 3 therein and has a partly opened cylindrical surface, is rotatably secured to the pair of radiant sensor holder pivotably securing plate 22. The radiant sensor holder 6 is provided with four projections 24 along substantially half the upper periphery so as to project in the radial directions.

A drive motor 18 is attached to the drive motor fixing plate 21, and a motor shaft 18a of the drive motor 18 penetrates through the drive motor fixing plate 21. The direction of the motor shaft 18*a* extends in the same direction as the axis of rotation of the radiant sensor holder 6, and hence both are parallel to each other.

A sector-shaped connecting member 25 is fixedly connected to the motor shaft 18*a*, and three pins 26 are protruded from the outer peripheral edge of the sector-shaped connecting member 25 toward the radiant sensor holder 6.

Then, the three pins 26 of the sector-shaped connecting member 25 are configured to be fitted respectively between the four projections 24 of the radiant sensor holder 6.

Therefore, the radiant sensor holder drive mechanism 7 includes the drive motor 18 mounted on the drive motor fixing plate 21, the sector-shaped connecting member 25 having the three pins 26 fixedly connected to the motor shaft 18a of the drive motor 18 and the four projections 24 provided along the upper periphery of the radiant sensor holder 6 and configured to receive the three pins 26 respectively therebetween.

The four projections 24 provided on the radiant sensor holder 6 are formed into the shape which does not impair the rotation of the drive motor 18 by interference with the pins 26 in a process in which the pins 26 on the sector-shaped connecting member 25 are moved toward and away from the portions between the projections 24 when the drive motor 18 is rotated.

Referring now to FIGS. 8A to 8C, the operation of the radiant sensor holder drive mechanism 7 will be described.

For example, when the drive motor 18 rotates from a state shown in FIG. 8A, the sector-shaped connecting member 25 which is fixedly connected to the motor shaft 18*a* of the drive motor 18 also rotates, and the three pins 26 provided on the sector-shaped connecting member 25 press the projections 24 provided on the upper periphery of the radiant sensor holder 6, so that the radiant sensor holder 6 is rotated leftward and rightward as shown in FIG. 8B or 8C.

As described above, according to the radiant sensor holder drive mechanism 7 in the first embodiment, the projections 24 provided on the upper periphery of the radiant sensor holder 6 are pressed by the three pins 26 provided on the sector-shaped connecting member 25 fixedly connected to the motor shaft 18*a* of the drive motor 18, so that the radiant sensor holder 6 is rotated leftward and rightward. Therefore, it is not necessary to provide the motor shaft 18*a* of the drive motor 18 on the axis of rotation of the radiant sensor holder 6. In addition, the radiant sensor holder drive mechanism 7 includes the sector-shaped connecting member 25 having the three pins 26 fixedly connected to the motor shaft 18*a* of the drive motor 18 and the four projections 24 provided on the upper periphery of the radiant sensor holder 6 so as to receive the three pins 26 respectively therebetween besides the drive motor 18. Therefore, the components are simplified to make it possible to assemble easily with simplified components. Even though the radiant sensor holder 6 and the drive motor 18 are apart from each other, the sector-shaped connecting member 25 is prevented from being deflected, and hence deviation of the drive angle may be prevented.

The number of the projections 24 and the number of the pins 26 are to be adjusted according to the angular range of rotation of the radiant sensor holder 6, and hence the numbers of the projections 24 and the pins 26 are not limited to four and three, respectively.

In addition, by forming the four projections 24 provided on the upper periphery of the radiant sensor holder 6 and the sector-shaped connecting member 25 having the three pins 26 fixedly connected to the motor shaft 18*a* of the drive motor 18 of a material having a good sliding property, for example, resin having a self lubricating property, driving of the radiant sensor holder 6 becomes smoother.

Referring now to FIG. 6 and FIG. 7, laying of the lead wires 14 at the time of driving the radiant sensor holder 6 will be described.

As shown in FIG. 6, the lead wires 14 connected to the radiant sensor holder 6 are drawn out from the side opposite to the position of the drive motor 18, and are laid from the rear side through the lateral side to the front side of the drive motor 18. Provided on the drive motor fixing plate 21 on the front side of the drive motor 18 is a band fixing member 29 for holding a band 28 fixed to the lead wires 14 in a state of being capable of moving in a predetermined range.

Therefore, since the lead wires 14 to be connected to the radiant sensor holder 6 are laid from the rear side through the lateral side to the front side of the drive motor 18, they are not touched and pulled by the pins 26 of the sector-shaped connecting member 25 fixedly connected to the motor shaft 18*a* or the projections 24 provided on the upper periphery of the radiant sensor holder 6 and hence the radiant sensor holder 6 can be rotated smoothly.

Figure 9:
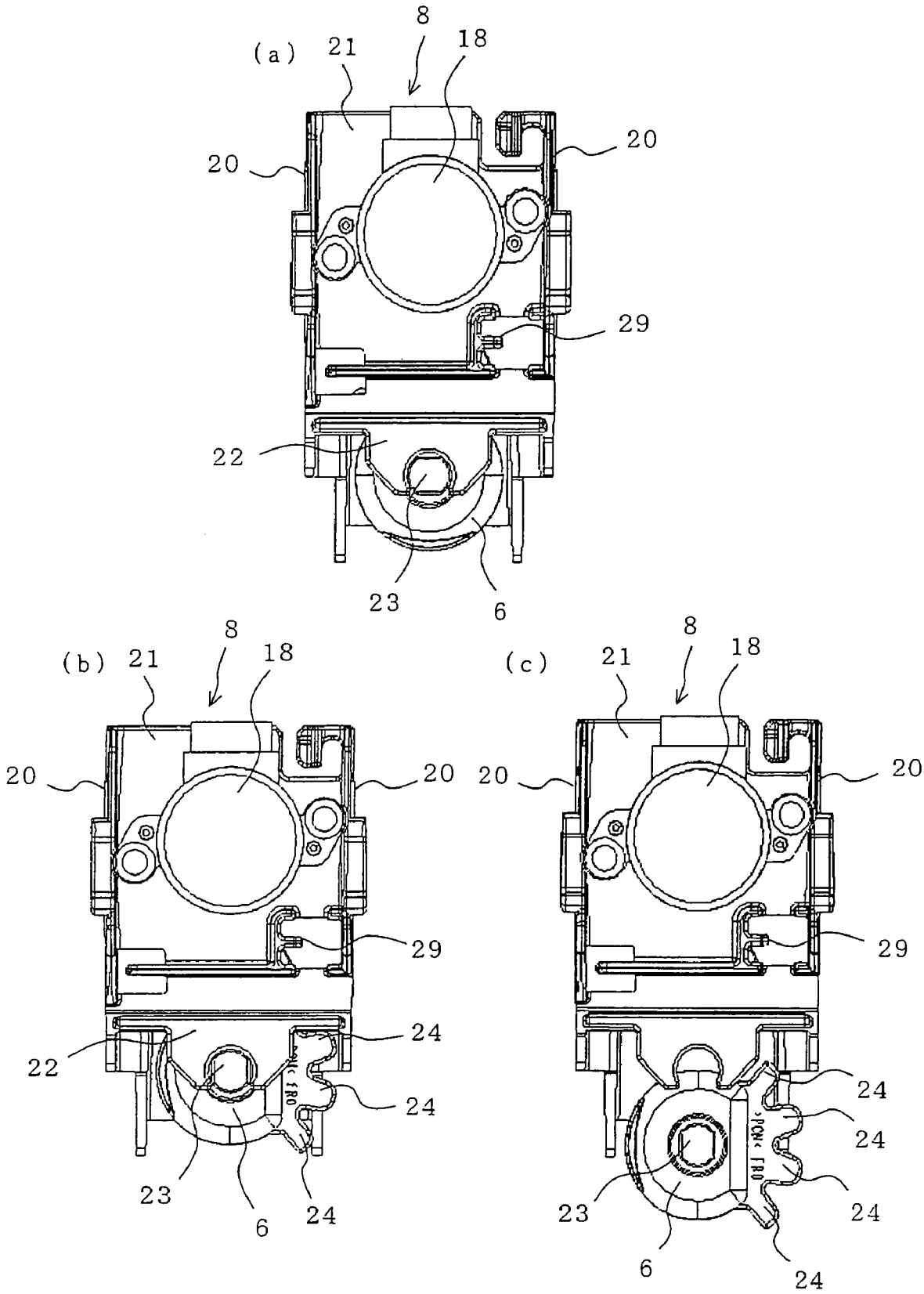
FIGS. 9A to 9C are an explanatory drawing showing a step of removing the radiant sensor holder of the air conditioner.

Referring now to FIG. 9, a configuration in which the round bosses 23, which are provided at the upper and lower portions on the rotation axis of the radiant sensor holder 6 and rotatably secured to the pair of radiant sensor holder pivotably securing plates 22 and 22, will be described in detail.

The radiant sensor holder pivotably securing plates 22, to which the bosses 23 of the radiant sensor holder 6 are rotatably secured, are each formed with a circular pivotably securing hole 22*a* and a part of the pivotably securing hole 22*a* is cut and opened.

Each round boss 23 of the radiant sensor holder 6 has a diameter slightly smaller than the diameter of the pivotably securing holes 22*a* of the radiant sensor holder pivotably securing plates 22, and its opposing peripheral edges are cut off in parallel to each other. The width of the remaining part of the boss 23 after having cut is slightly smaller than the width of the cut and opened portion of the pivotably securing hole 22*a* so that it can be inserted into the pivotably securing hole 22*a* from the cut and opened portion of the pivotably securing hole 22*a*.

Therefore, when the cut portion of the boss 23 of the radiant sensor holder 6 is inserted into the pivotably securing hole 22*a* from the cut and opened portion of the pivotably securing hole 22*a* of the radiant sensor holder pivotably securing plates 22 and the radiant sensor holder 6 is rotated by 90 degrees, the boss 23 is secured so as to be capable of rotating in the pivotably securing hole 22*a* since the diameter of round portion of the boss 23 is larger than the cut and opened portion of the pivotably securing hole 22*a*.

In a case in which the radiant sensor holder 6 is set up so as to look forward in this state and the radiant sensor holder 6 is rotating within a predetermined driving angle, the boss 23 does not come apart from the pivotably securing hole 22*a*. However, when the radiant sensor holder 6 is faced abeam beyond the predetermined driving angle, that is, when it is rotated by 90 degrees, since the diameter of the cut portion of the boss 23 is smaller than the cut and opened portion of the pivotably securing hole 22*a*, the cut portion of the boss 23 comes apart from the cut and opened portion of the pivotably securing hole 22*a* and hence the radiant sensor holder 6 comes apart from the pivotably securing holes 22*a* of the radiant sensor holder pivotably securing plates 22.

Therefore, when the radiant sensor holder 6 is rotated within less than 90 degrees, the boss 23 of the radiant sensor holder 6 does not come apart from the pivotably securing hole 22*a* of each radiant-sensor holder pivotably securing plate 22.

As described thus far, the boss 23 of the radiant sensor holder 6 can be pivotably secured to the radiant sensor holder pivotably securing plate 22 only by cutting a part of the pivotably securing hole 22*a* of the radiant sensor holder pivotably securing plate 22 and by cutting the upper and lower parts of the round boss 23 of the radiant sensor holder 6. Consequently, since it is not necessary to provide separate components, the number of components can be significantly reduced and, in addition, the boss 23 of the radiant sensor holder 6 can be pivotably secured to the pivotably securing hole 22*a* of the radiant sensor holder pivotably securing panels 22 without using a tool easily.

Figure 10:
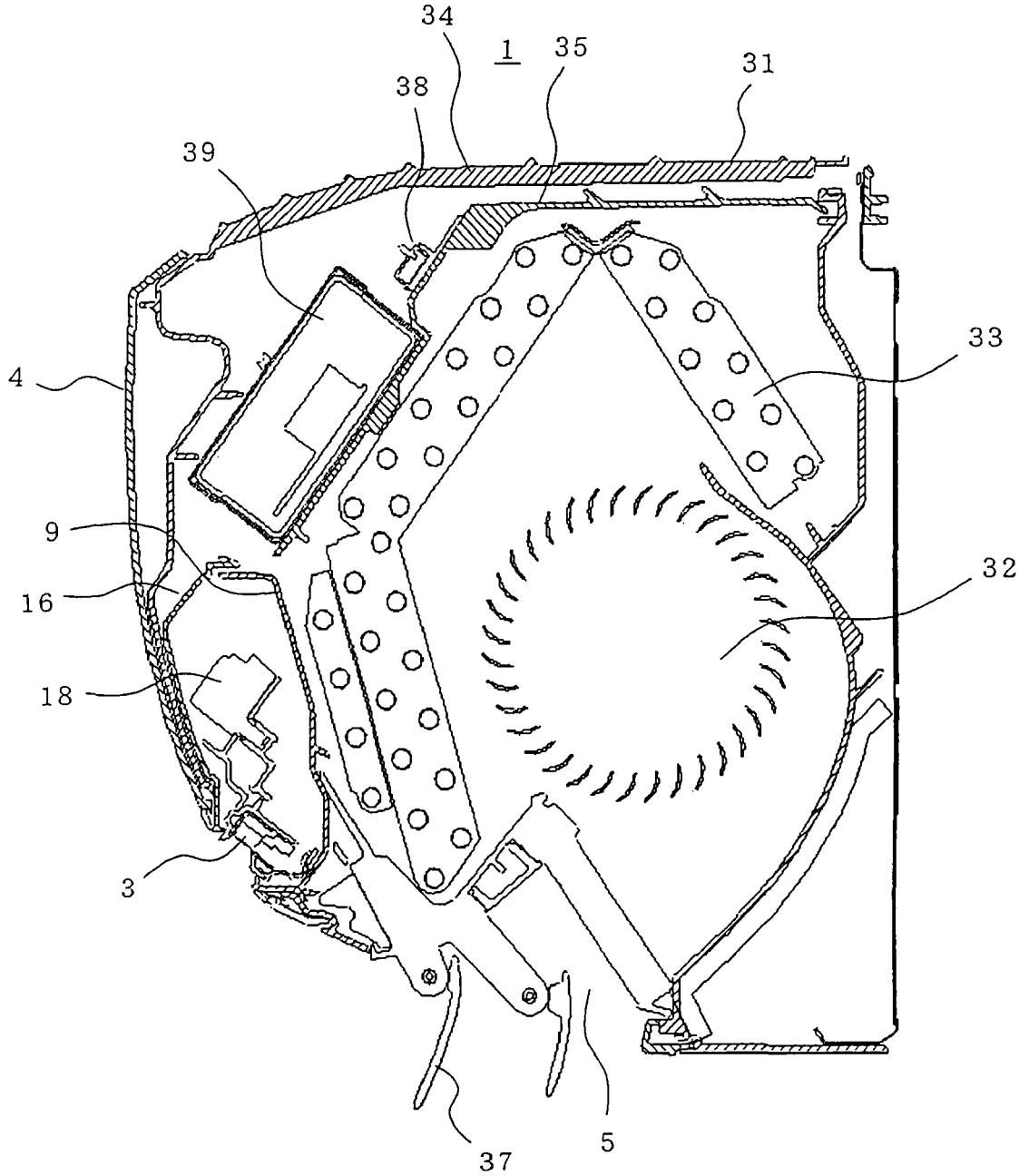
FIG. 10 is a cross-sectional view showing an internal structure of the indoor unit of the air conditioner.
Figure 11:
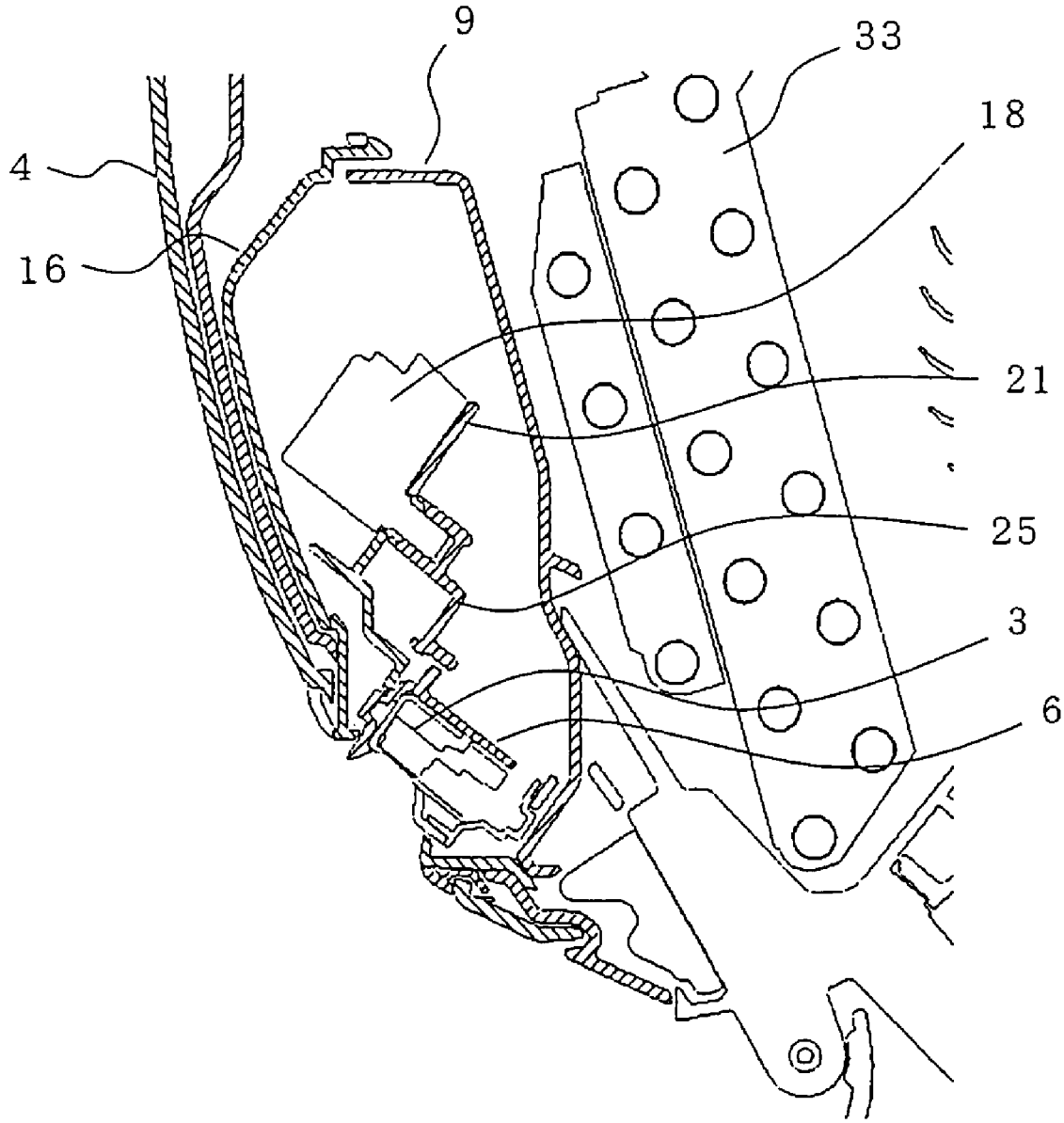
FIG. 11 is a cross-sectional view of a part of the internal structure of the indoor unit of the air conditioner in an enlarged scale.

FIG. 10 is a cross-sectional view showing an internal structure of the indoor unit of the air conditioner, and FIG. 11 is a cross-sectional view of a part of the internal structure of the indoor unit of the air conditioner in an enlarged scale.

As shown in FIG. 10 and FIG. 11, the indoor unit 1 of the air conditioner includes a housing 31 having the front panel 4. It also includes an air blower 32 and a heat exchanger 33 for a refrigerating cycle which is bent to have multiple planes so as to surround the air blower 32 and installed on the front surface and the rear surface of the air blower 32, installed inside of the housing 31.

By rotating the air blower 32, air in the room enters inside of the indoor unit 1 of the air conditioner from an inlet port 34 on the upper surface thereof, and is guided to the heat exchanger 33 after having removed dust and the like by a filter 35 provided on the upstream side of the heat exchanger 33, and heat-exchanges with a refrigerant of the refrigerating cycle.

The air in the room after having heat-exchanged becomes conditioned air, and passes through a wind path 36 defined by the housing 31 on the downstream side of the air blower 32, and is sent to the air outlet port 5, and then is blown out to the room after having adjusted in direction by a wind direction adjusting device 37.

Provided between the heat exchanger 33 and the inlet port 34 are a plasma generating device 38 for charging dust included in air in the room sucked from the inlet port 34 to allow the filter 35 to collect the dust easily and generating ozone to sterilize and clean the heat exchanger 33 and a power source box 39 for supplying power to the plasma generating device 38.

The sensor holder 2 is installed inside the front panel 4 at the center of the indoor unit 1 of the air conditioner as described above. The radiant sensor device assembly 8 is fixedly attached to the assembly fixing portion 9 at the center of the sensor holder 2. The radiant sensor holder 6 holding the radiant sensor 3 and the radiant sensor holder drive mechanism 7 for rotating the radiant sensor holder 6 are assembled into the radiant sensor device assembly 8.

According to the radiant sensor holder drive mechanism 7 configured as shown in FIG. 10 and FIG. 11, since the radiant sensor holder 6 is rotated leftward and rightward by the three pins 26 provided on the sector-shaped connecting member 25 fixedly connected to the motor shaft 18*a* of the drive motor 18, pushing the projections 24 provided at the upper periphery of the radiant sensor holder 6, it is not necessary to provide the motor shaft 18*a* of the drive motor 18 on the axis of rotation of the radiant sensor holder 6. Therefore, the drive motor 18 can be positioned inside the front panel 4 and inside the axis of rotation of the radiant sensor holder 6 at the position above the radiant sensor holder 6. Therefore, the radiant sensor holder 6 and the radiant sensor holder drive mechanism 7 can be positioned at the center of the indoor unit 1, and hence the temperature of the floor surface over a wide range in the room can be detected, and the design of the indoor unit 1 in appearance is also improved.

What is claimed is:

1. An air conditioner comprising an indoor unit including: a front panel; a radiant sensor for detecting a temperature; a radiant sensor holder for holding the radiant sensor, the radiant sensor holder being arranged inside the front panel and capable of rotating leftward and rightward, wherein a radiant sensor device assembly is provided inside the front panel of the indoor unit; the radiant sensor holder and a radiant sensor holder drive mechanism for driving the radiant sensor holder are assembled into the radiant sensor device assembly; and the radiant sensor holder drive mechanism includes a plurality of projections provided on a part of the outer periphery of the radiant sensor holder so as to project in the radial directions, a drive motor attached to the radiant sensor device assembly so that the direction of the shaft of the drive motor extends in the same direction as the axis of rotation of the radiant sensor holder, and a sector-shaped connecting member being attached to the shaft of the drive motor and having a plurality of pins to be fitted between the plurality of projections provided on the radiant sensor holder respectively for driving the projections.

2. The air conditioner according to claim 1, comprising: a pair of radiant sensor holder pivotably securing plates being provided in the radiant sensor device assembly and each having a pivotably securing hole a part of which is cut and opened; and round bosses provided at the upper and lower portions of the radiant sensor holder on the axis of rotation so as to be secured to the pivotably securing holes, wherein each of the bosses is cut off at the opposing peripheral edges thereof in parallel to each other, and wherein the width of the remaining part of the boss after having cut is slightly smaller than the width of the cut and opened portion of the pivotably securing hole so as to be capable of being inserted into the pivotably securing hole from the cut and opened portion thereof.

3. The air conditioner according to claim 1, further comprising a sensor holder, wherein the sensor holder includes an assembly fixing portion provided in the middle thereof for fixedly attaching and housing the radiant sensor device assembly therein, a plurality of display portions provided on the left side thereof, a plurality of display portions and a remote control receiver portion provided on the right side thereof, display substrate holders for holding a display substrate when being folded, the display substrate holders being provided respectively on one side of the display portions and the remote control receiver portion via hinge structures, and a lead holding unit having a hinge structure for holding the lead wires extended to the display portions and the remote control receiver portion when being folded, the lead holding unit being provided at an end of the remote control receiver portion, wherein the sensor holder is formed integrally of synthetic resin and is disposed inside the front panel of the indoor unit.

4. The air conditioner according to claim 2, further comprising a sensor holder, wherein the sensor holder includes an assembly fixing portion provided in the middle thereof for fixedly attaching and housing the radiant sensor device assembly therein, a plurality of display portions provided on the left side thereof, a plurality of display portions and a remote control receiver portion provided on the right side thereof, display substrate holders for holding a display substrate when being folded, the display substrate holders being provided respectively on one side of the display portions and the remote control receiver portion via hinge structures, and a lead holding unit having a hinge structure for holding the lead wires extended to the display portions and the remote control receiver portion when being folded, the lead holding unit being provided at an end of the remote control receiver portion, wherein the sensor holder is formed integrally of synthetic resin and is disposed inside the front panel of the indoor unit.

5. The air conditioner according to claim 3, comprising an assembly fixing portion cover provided on the assembly fixing portion via a hinge structure, for covering the assembly fixing portion of the sensor holder.

6. The air conditioner according to claim 4, comprising an assembly fixing portion cover provided on the assembly fixing portion via a hinge structure, for covering the assembly fixing portion of the sensor holder.

* * * * *